United States Patent [19]

Nosaki et al.

[11] Patent Number: 4,558,941

[45] Date of Patent: Dec. 17, 1985

[54] DEVELOPING APPARATUS

[76] Inventors: Takefumi Nosaki, Toshiba-Isogo-Dairoku-Ryo, 2-8-2, Shiomidai, Isogo-ku, Yokohama-shi; Koji Tanimoto, Toshiba-Shinkoyasu-Daiichi-Ryo, 2-14-10, Shinkoyasu, Kanagawa-ku, Yokohama-shi; Masahiro Hosoya, Toshiba-Kikuna-Ryo, 217 Mamedo-cho, Kohoku-ku, Yokohama-shi, all of Japan

[21] Appl. No.: 594,532

[22] Filed: Mar. 29, 1984

[30] Foreign Application Priority Data

| | | | |
|---|---|---|---|
| Mar. 31, 1983 | [JP] | Japan | 58-55979 |
| Mar. 31, 1983 | [JP] | Japan | 58-56009 |
| Mar. 31, 1983 | [JP] | Japan | 58-56049 |

[51] Int. Cl.[4] ..... G03G 15/06

[52] U.S. Cl. ..... 355/3 DD; 118/648

[58] Field of Search ..... 355/3 DD, 10, 14 D; 118/647, 648, 653–658; 430/120–123

[56] References Cited

U.S. PATENT DOCUMENTS

| | | | |
|---|---|---|---|
| 3,651,784 | 3/1972 | Hewitt | 118/648 X |
| 3,707,943 | 1/1973 | Matsumoto et al. | 118/648 X |
| 3,818,864 | 6/1974 | Bickmore | 355/3 DD |
| 3,831,556 | 8/1974 | Sato et al. | 118/648 X |
| 4,021,111 | 5/1977 | Kuroishi et al. | 355/10 |

*Primary Examiner*—R. L. Moses

[57] ABSTRACT

A developing apparatus has a toner carrier having a horizontal portion disposed near the surface of a photoconductive member on which an electrostatic latent image is formed, and an inclined portion having one end portion embedded in a toner. The horizontal and inclined portions having strip electrodes thereon. A voltage circuit applies to the strip electrodes potentials, which change in a stepwise manner as a time function, so as to form electric fields shifting from the inclined portion to the horizontal portion. An opposed electrode is disposed to oppose the inclined portion. A voltage, which is half the maximum value of the potentials applied to the strip electrodes of the toner carrier, is applied to the opposed electrode.

16 Claims, 25 Drawing Figures

DEVELOPING APPARATUS

BACKGROUND OF THE INVENTION

The present invention relates to a developing apparatus used in an electronic copying arrangement to develop an electrostatic latent image formed on a surface of a photoconductive member.

Conventionally, a magnetic brush developing method, a cascade developing method, and a fur brush developing method are known as methods for developing an electrostatic latent image. A new developing method has been developed recently in addition to these conventional methods. According to this new developing method, a toner carrier member is disposed to oppose the surface of the photoconductive drum. This member has a number of strip electrodes, arranged at equal intervals thereon. A potential, which changes as a time function, is sequentially applied to strip electrodes to generate alternating electric fields therebetween. A nonmagnetic toner is shifted between the electrodes along the direction of the electrode array. In this case, the toner is moved upward toward the photoconductive drum, vibrates, and floats in the form of smoke-like particles. In this state, the toner is supplied to the photoconductive drum to develop the latent image into a toner image.

A developing method of this type has the following problem. When voltage is applied to electrodes, which do not correspond to the electrostatic latent image, the intensity of the electric fields is strong in the portion between the electrodes and becomes substantially zero at the center of the electrode. For this reason, the toner particles are shifted by a strong electric field in the portion between the electrodes. However, no electric lines of force act on the toner particles at the center of the electrode. As a result, the toner particles are stacked on the electrode. This toner stack interferes with toner feeding and reduces the toner transport efficiency.

SUMMARY OF THE INVENTION

It is an object of the present invention to provide a multi-electrode type developing apparatus capable of improving the transport efficiency of a developing medium, such as a toner.

According to the invention, a developing apparatus comprises a developing-medium carrier member having a plurality of strip electrodes arranged at predetermined intervals on a substrate. The developing-medium carrier member has a developing section disposed to oppose a photoconductive member, and a carrying section for transporting the developing medium to the developing section. An electrode member is disposed to oppose the carrying section. A circuit is provided to apply a predetermined potential to the electrode member to densify the distribution of electric fields at a central portion of the electrode member.

DETAILED DESCRIPTION OF THE PREFERRED EMBODIMENTS

Figure 1:
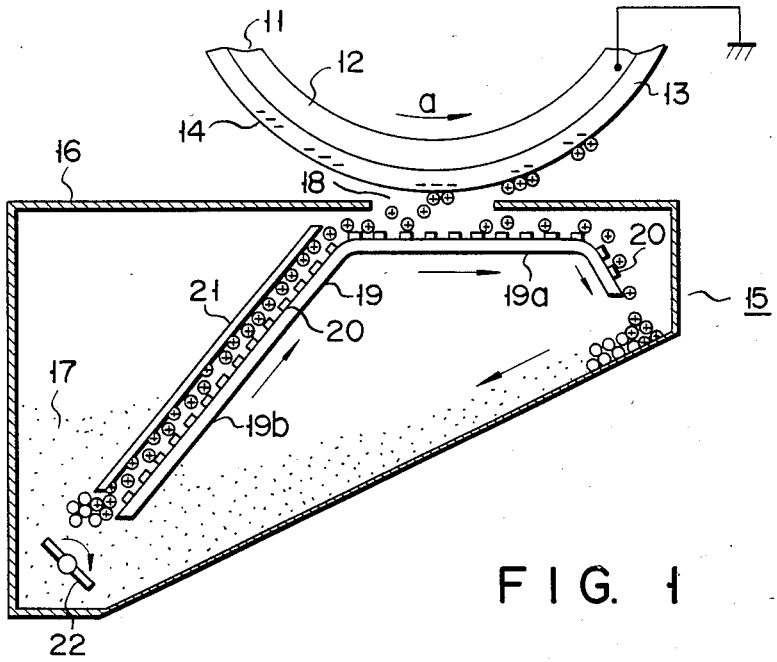
FIG. 1 is a schematic diagram of the structure of a developing apparatus, according to an embodiment of the present invention.

Referring to FIG. 1, a photoconductive drum 11 comprises an aluminum drum 12 and a selenium/tellurium based photoconductive layer 13 formed on the aluminum drum 12, and is grounded. A negatively charged electrostatic latent image 14 is formed on the photoconductive layer 13. A developing apparatus is disposed to oppose the photoconductive drum 11. A nonmagnetic toner 17 is stored as a developing medium in a toner container 16 of the developing apparatus. The toner container 16 has an opening 18 which opposes the photoconductive drum 11. The bottom of the toner container 16 has an inclined surface, which descends from the right to the left in FIG. 1. A toner carrier 19 is disposed inside the toner container 16. This toner carrier 19 has a horizontal portion **19*a* located up to 2.0 mm from the photoconductive drum 11, and an inclined portion 19*b* extending from one end of the horizontal portion 19*a* in the lower left direction. The lower end of the inclined portion 19*b* is embedded in the toner 17**.

Figure 2:
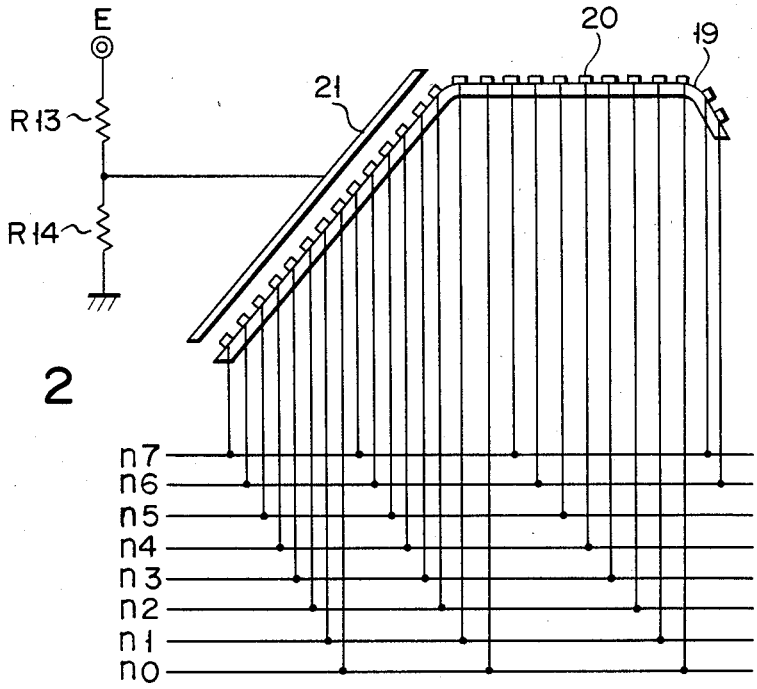
FIG. 2 is a wiring diagram of strip electrodes of the apparatus shown in FIG. 1.

Copper strip electrodes 20 are arranged on the toner carrier 19 parallel to the axis of the photoconductive drum 11 and aligned at equal intervals along the longitudinal direction of the toner carrier 19. These strip electrodes 20 are formed on a toner carrier substrate by printing, etching, vapor evaporation, etc. The width of each strip electrode 20 is about 0.1 to 0.5 mm, and the interval between two adjacent electrodes, or pitch, is about 0.1 to 0.5 mm. An electrode plate 21 is disposed to oppose a portion (e.g., the electrodes 20 formed on the inclined portion 19*b*) of the toner carrier 19 which does not oppose the photoconductive drum 11. In this case, the distance between the electrodes 20 and the electrode plate 21 is set to be about 0.2 to 1.0 mm. The electrode plate 21 is set at a potential below the potential applied to the strip electrodes 20. The potential of the electrode plate 21 is obtained by, for example, shunting a power supply voltage E by resistors R13 and R14, as shown in FIG. 2. The resistors R13 and R14 have the same resistance, so that a potential of E/2 is applied to the electrode plate 21.

The electrodes 20 are sequentially connected to voltage lines n0 to n7, as shown in FIG. 2. In particular, every eighth electrode is connected to the same voltage line, so that the electrodes commonly connected to each of the voltage lines n0 to n7 constitute a group, thereby obtaining eight electrode groups N0 to N7.

Figure 3:
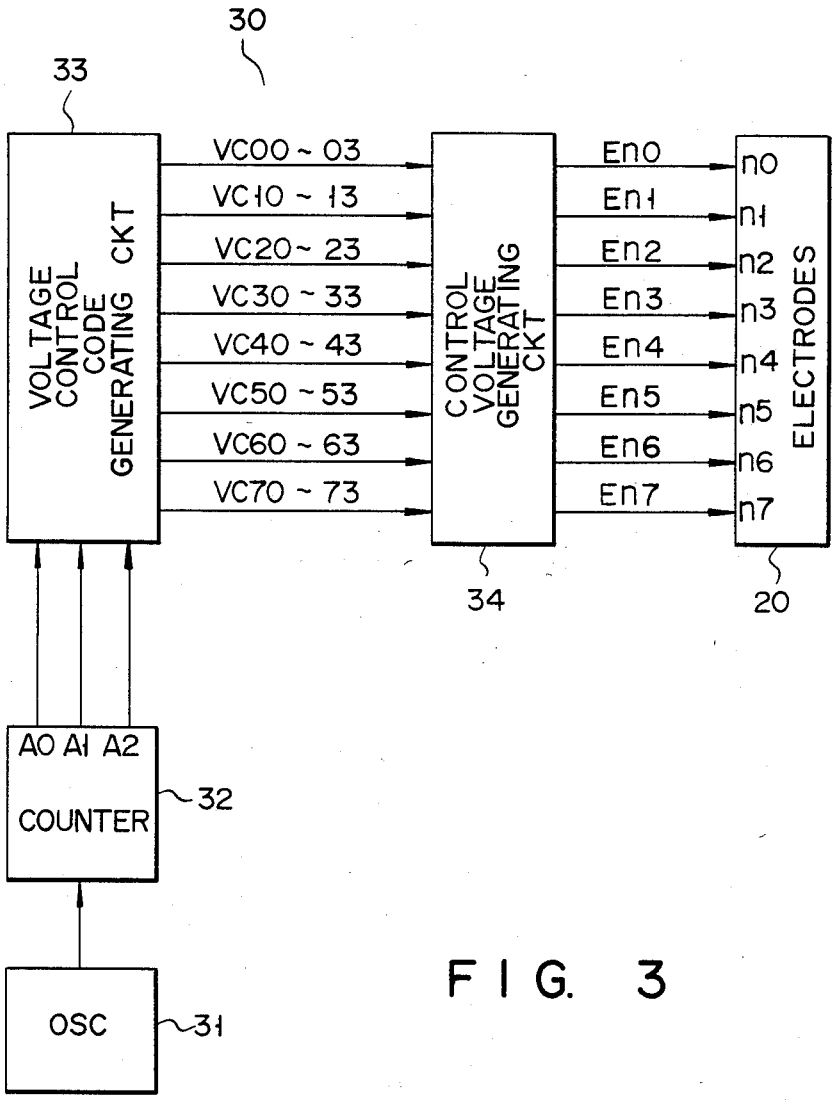
FIG. 3 is a block diagram of a circuit for applying a control voltage to the group of strip electrodes.
Figure 4:
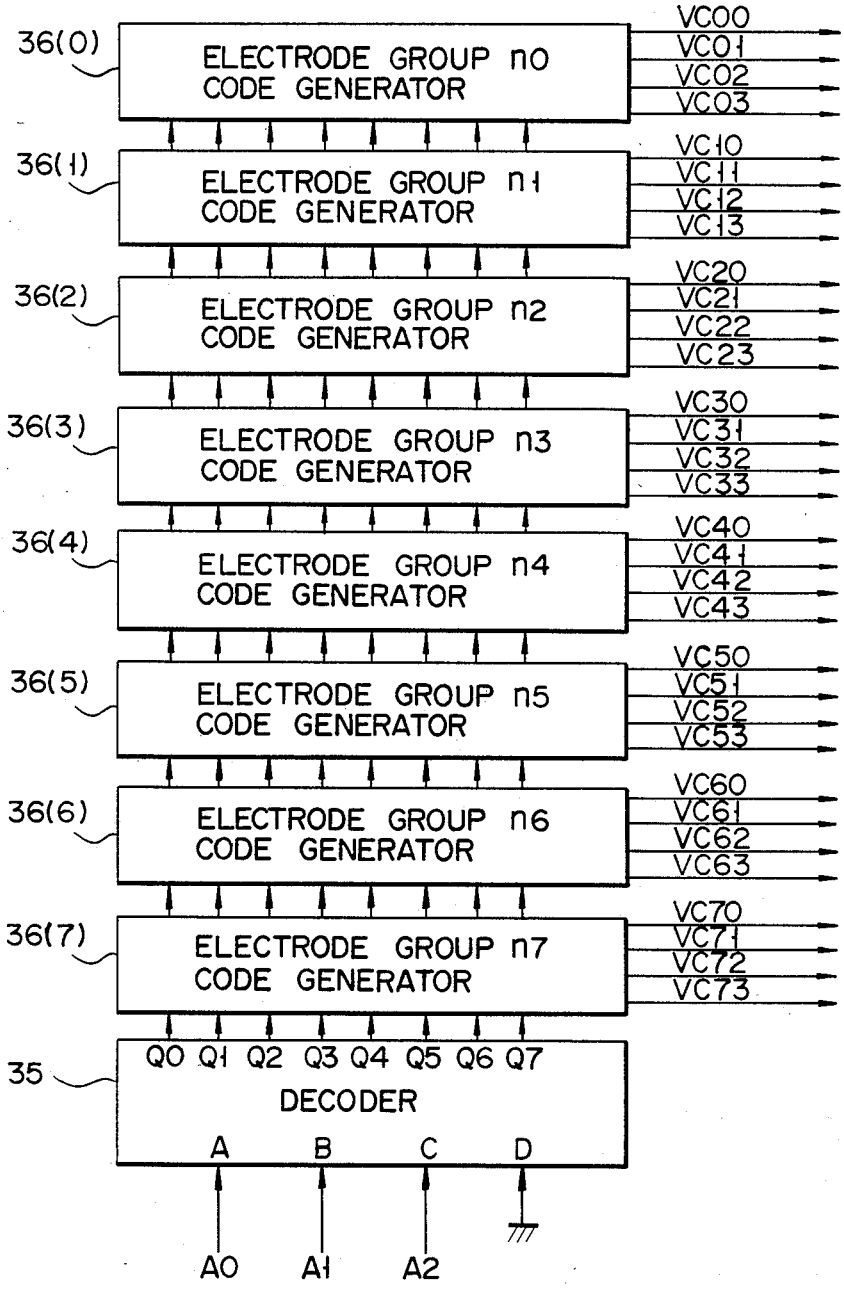
FIG. 4 is a block diagram of a voltage-control-code generating circuit in the circuit shown in FIG. 3.

A control voltage is applied from a control voltage circuit section 30 (FIG. 3) to the electrodes 20. In this control voltage circuit section 30, a reference oscillator 31 generates an oscillation signal, which determines the scanning rate of the electrodes 20. The reference oscillator 31 is connected to a modulo 8 counter 32. Outputs A0, A1 and A2 of the modulo 8 counter 32 are coupled to a voltage control code generator 33. The code generator 33 generates voltage control codes VC00 to VC03, VC10 to VC13, VC20 to VC23, VC30 to VC33, VC40 to VC43, VC50 to VC53, VC60 to VC63 and VC70 to VC73 in accordance with output values of the counter 32. The output terminals of the voltage-control-code generating circuit 33 are connected to a control voltage-generating circuit 34. The voltage-control-code generating circuit 33 is arranged as shown in FIG. 4. In particular, the input terminals of a decoder 35 are connected to the counter 32, and the output terminals thereof are connected to a first stage, i.e., code generator 36(7) of code generators 36(0) to 36(7), which are connected to each other in series. Each of the code generators 36(0) to 36(7) comprises a diode matrix circuit (ROM) and stores codes corresponding to addresses. Each code generators 36(0) to 36(7) generates a voltage code in accordance with addresses specified by the counter 32.

Figure 5:
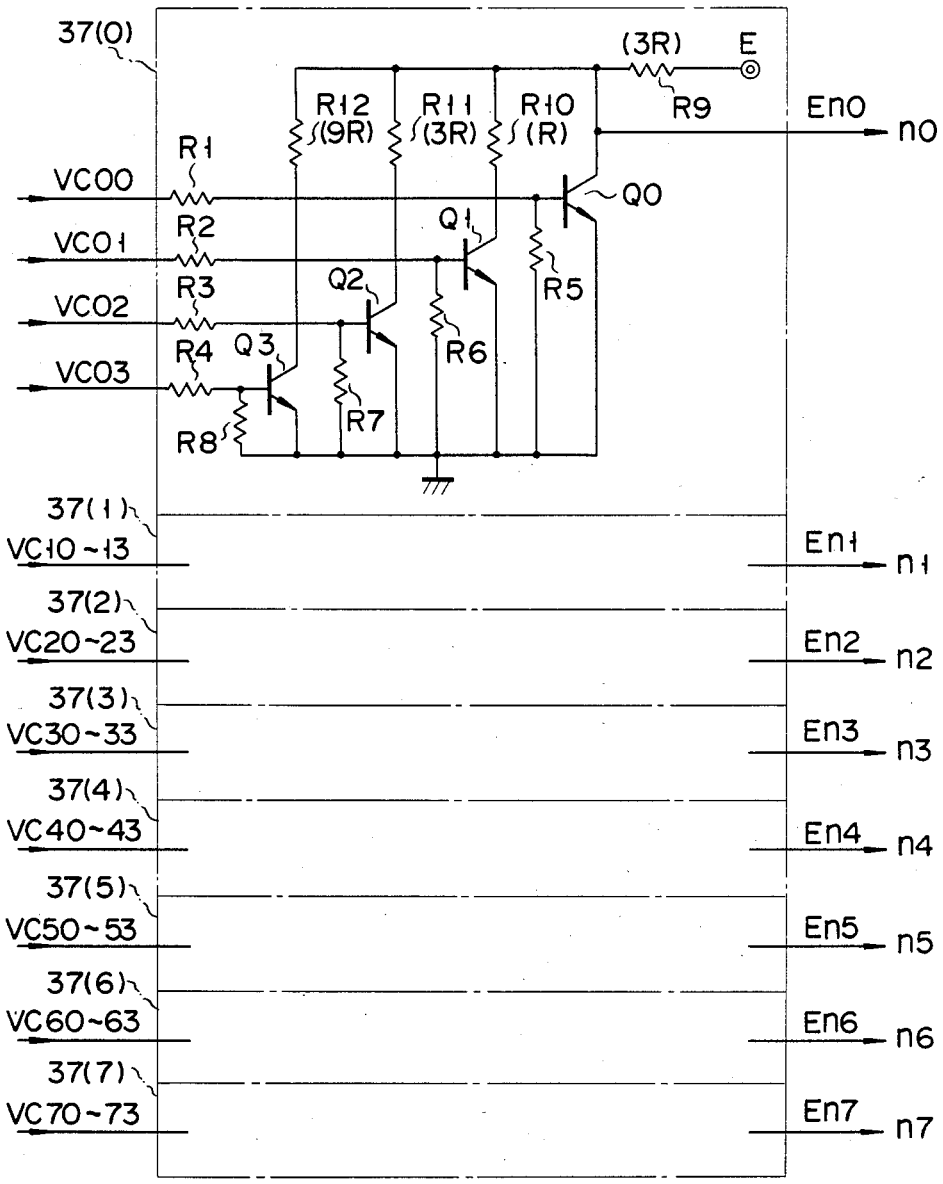
FIG. 5 is a circuit diagram of a control-voltage generating circuit in the circuit shown in FIG. 3.

The control voltage-generating circuit 34, shown in FIG. 5, comprises voltage generators 37(0) to 37(7), which respectively generate voltages En0 to En7 corresponding to the codes generated from the voltage-control-code generating circuit 33. The voltage generator 37(0) comprises transistors Q0 to Q3 whose bases are respectively connected to bit lines of the voltage control codes (VC00 to VC03) through resistors R1 to R8 and are grounded through the resistors R5 to R8 and resistors R9 to R12, respectively connected to the collectors of the transistors Q0 to Q3. When the resistor R10 has a resistance r, each of the resistances of the resistors R9 and R11 is set to be 3 r, and the resistance of the resistor R12 is set to be 9 r. Other voltage generators 37(1) to 37(7) have the same arrangement as the circuit 37(0). The following table shows the relationship between the voltage control codes (e.g., VC00 to VC03) and the output voltages (En0):

TABLE

| | Voltage Control Code | | | | Output Voltage |
|---|---|---|---|---|---|
| Mode | VC00 | VC01 | VC02 | VC03 | En0 |
| M0 | 1 | 0 | 0 | 0 | 0 |
| M1 | 0 | 1 | 0 | 0 | E/4 |
| M2 | 0 | 0 | 1 | 0 | E/2 |
| M3 | 0 | 0 | 0 | 1 | 3E/4 |
| M4 | 0 | 0 | 0 | 0 | E |

There are five modes M0 to M4 for supplying to the control voltage-generating circuit 34 four-bit data, each consisting of the voltage control codes VC00 to VC03. In the respective modes, output voltages En0 are set to be 0, E/4, E/2, 3E/4 and E. The above description can also be applied to other voltage control codes.

Figure 6:
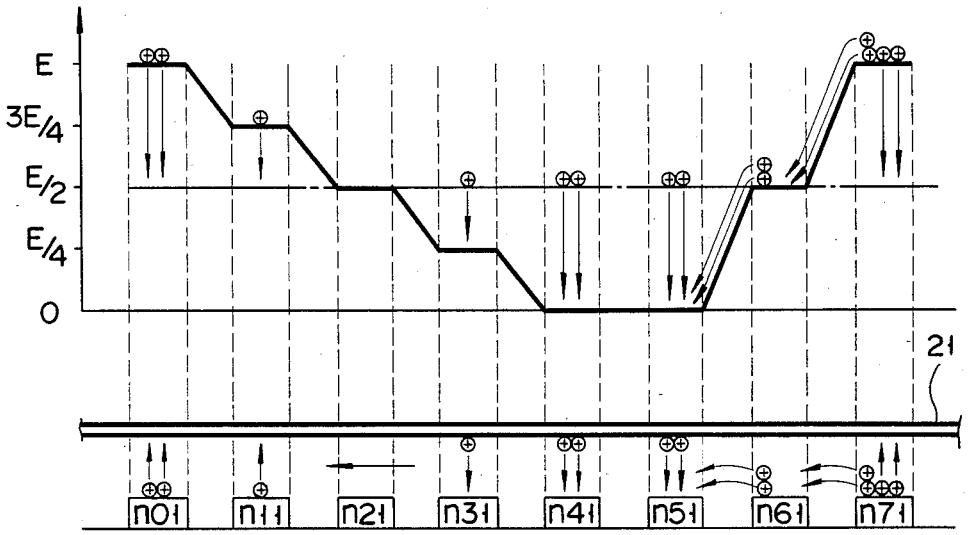
FIGS. 6 to 8 are graphs, each showing the relationship between the voltage applied to the strip electrodes and the corresponding toner transfer state thereof.
Figure 7:
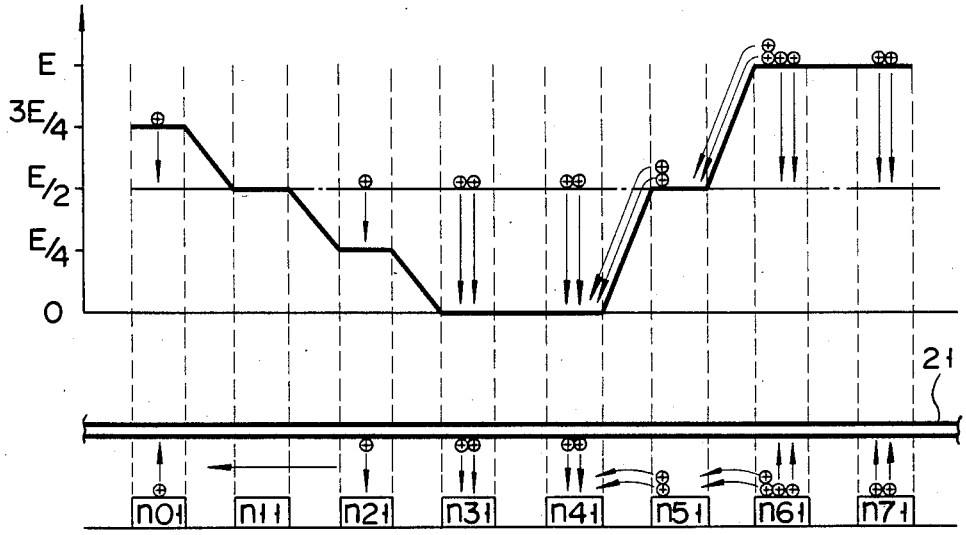
Figure 8:
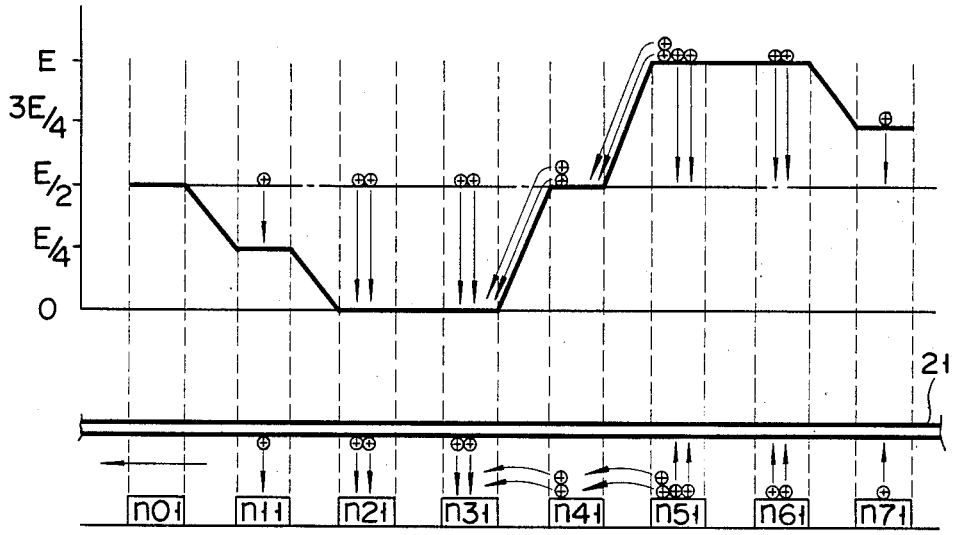
Figure 9:
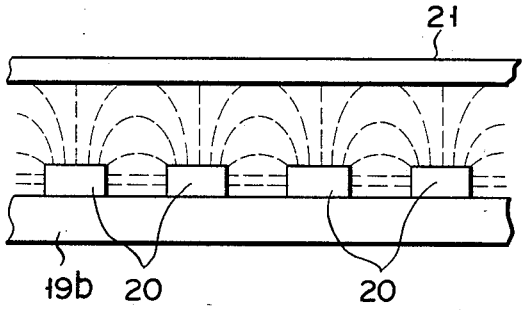
FIG. 9 is a diagram showing the distribution of electric lines of force in the strip electrodes.

The relationship between the voltage applied to the strip electrodes 20 and the electrode plate 21 and the toner transfer state will now be explained with reference to FIGS. 6 to 8. In FIGS. 6 to 8, the applied potential distribution corresponds to individual strip electrodes n01, n11, n21, n31, n41, n51, n61 and n71. The solid line indicates the potential applied to the strip electrodes, and the dotted line indicates the potential applied to the electrode plate 21. As shown in FIG. 9, when a potential of E/2 is applied to the electrode plate 21 and a potential indicated by the solid line is applied to the strip electrodes n01 to n71, the positively charged toner particles ⊕ are repelled by the electrode n71 due to the potential thereof, so that the toner particles located at the end of the electrode n71 are shifted to the electrode n61, which has a lower potential than that of the electrode n71. The toner particles ⊕ located at the central portion of the electrode n71 are shifted to the electrode plate 21. Subsequently, the toner particles ⊕ on the electrode n61 are shifted to the electrode n51, which has a still lower potential than that of the electrode n61. In this case, since the potential of the electrode n61 is substantially the same as that of the electrode plate 21, the toner particles ⊕ will not be shifted to the electrode plate 21. However, the toner particles ⊕ on the electrode plate 21 are shifted to the electrode n51, since the potential of the electrode n51 is lower than that of the electrode plate 21. Similarly, the toner particles ⊕ are shifted from the electrode plate 21 to the electrodes n41 and n31, and the toner particles ⊕ are shifted from the electrodes n11 and n01 to the electrode plate 21. In this case, the potential difference between the electrodes n01 and n11, n11 and n21, n21 and n31, and n31 and n41 is small. The toner particles ⊕ are shifted laterally or in a substantially lateral direction, so that the amount of toner transfer is small. When the potential distribution changes, as shown in FIG. 7 and 8, toner particles are further shifted by one electrode pitch. In this manner, when the potential distribution is shifted to the left, the toner particles ⊕ are shifted from the right to the left.

When the potential is sequentially applied to the electrode plate 21, alternating electric fields, shifting from the left to the right, are generated on the surface of the toner carrier 19, so that the toner particles ⊕ are made to vibrate and float between the electrodes in the form of smoke by the behavior of the alternating electric fields.

Development is performed while the toner particles are transported in the manner described above. The left end portion of the toner carrier 19 is embedded in the toner 17, which becomes positively charged upon friction with the toner carrier 19. Therefore, when the alternating electric fields are generated, the toner particles ⊕ vibrate and float in the form of smoke between the electrodes and are transported on the inclined section 19*b* of the toner carrier 19 in the upper right direction. The transported toner particles ⊕ are attracted from the horizontal portion 19*a* to the electrostatic latent image 14 formed on the photoconductive drum 11, thereby developing the latent image. The toner particles ⊕, which are not subjected to development, are transported to the right and drop from the right end portion of the toner carrier 19. The dropped toner particles ⊕ are transported along the inclined surface of the bottom of the toner container 16 in the lower left direction. The transported toner 17 returns to the left end of the toner carrier 19 and is stirred by a stirrer 22.

As described above, since the electrode plate 21 opposes the strip electrodes 20 of the toner carrier 16, the distribution of the electric lines of force, as shown in FIG. 9, can be obtained. The electric lines of force are dense even in the central portion of each electrode and extend above each electrode. As a result, strong electric fields are generated even in the vicinity of the center of the electrode as well as the portion between every two adjacent electrodes, so that the electric fields effectively carry the toner particles. Therefore, the toner particles ⊕, located at the center of each electrode, are actively shifted by the upward force. The toner particles are not stacked at the central portion of each electrode, and shifting of the toner 16 in a lateral direction is not interfered with, thereby improving toner transport efficiency.

Figure 10:
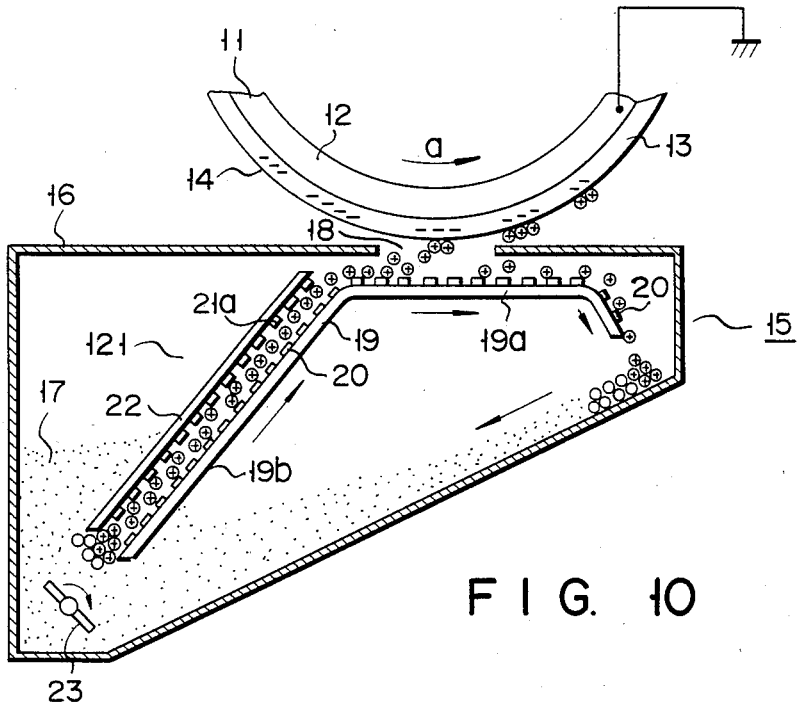
FIG. 10 schematically shows a structure of a developing apparatus, according to another embodiment of the present invention.

FIG. 10 shows a developing apparatus according to another embodiment of the present invention. According to this embodiment, a multi-electrode plate 121 is disposed to oppose an inclined section 19*b* of a toner carrier 19. The multi-electrode plate 121 comprises an insulative plate 22 and a number of strip electrodes 21*a* aligned at equal intervals thereon. The strip electrodes 21*a* are of the the same material, and have the same width and pitch as the strip electrodes 20 of the toner carrier 19. When the electrode plate 121 opposes the toner carrier 19, the electrodes 21*a* oppose the portions between every two adjacent electrodes 20 in such a manner that the electrodes 21*a* of the plate 121 are spaced by 0.2 to 1.0 mm apart from the electrodes 20 of the toner carrier 19.

Figure 11:
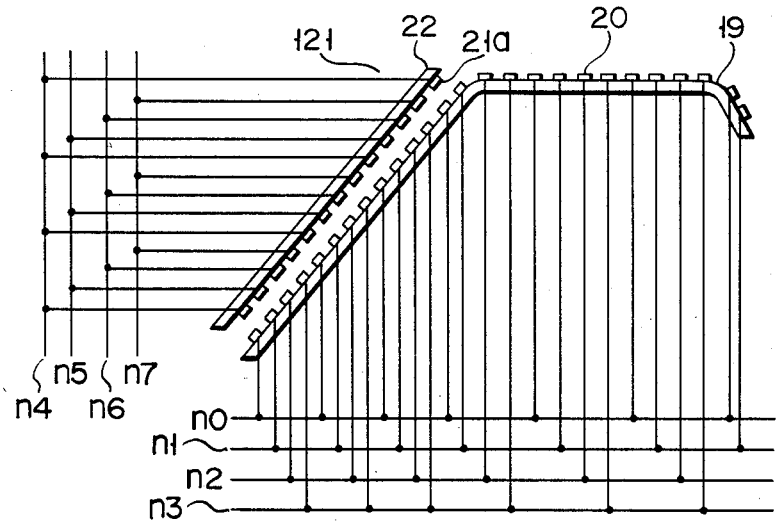
FIG. 11 is a wiring circuit of strip electrodes of the apparatus shown in FIG. 10.
Figure 12:
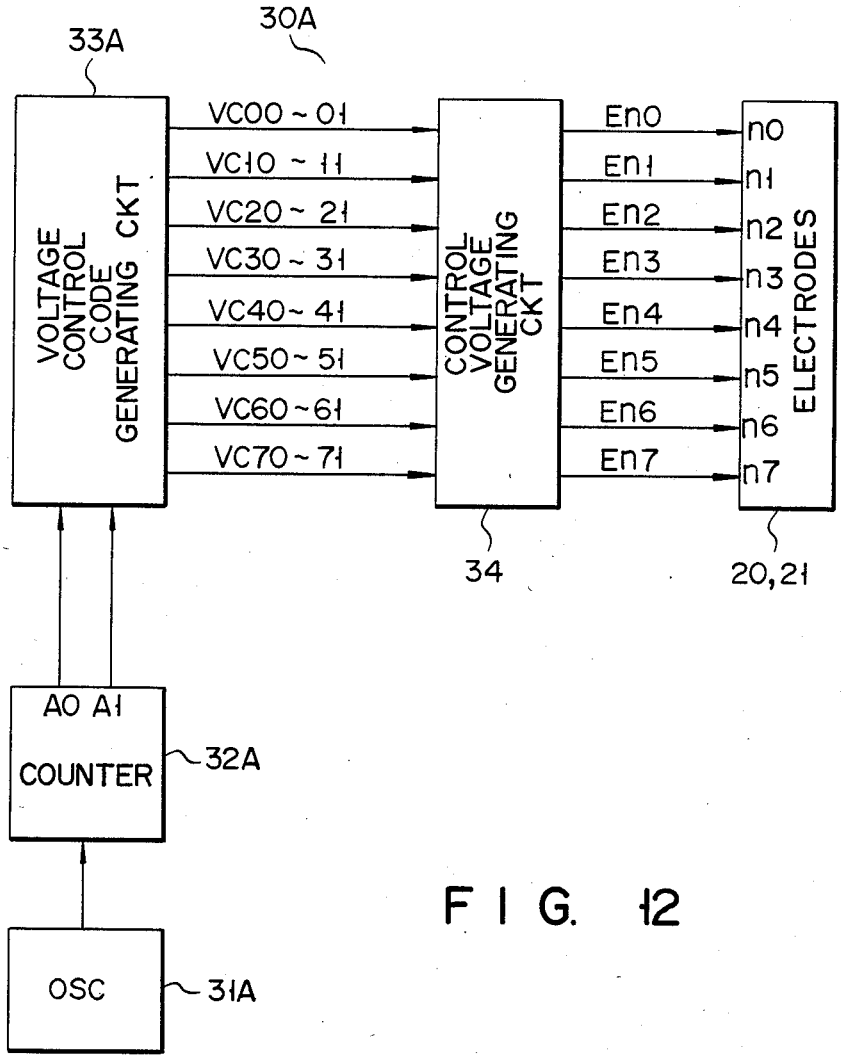
FIG. 12 is a block diagram of a circuit for applying a control voltage to the strip electrodes shown in FIG. 11.

The electrodes 20 and 21*a* are wired, as shown in FIG. 11. The electrodes 20 are connected to lines in the order n0, n1, n2 and n3, and the electrodes 21*a* are connected to lines in the order n4, n5, n6 and n7. In other words, each one of the lines n0 to n7 is connected to every fourth electrode. The electrodes commonly connected to each of the lines n0 to n7 constitute one group. A voltage is applied from a control voltage circuit section 30A (FIG. 12) to the lines n0 to n7, which are connected to the electrodes 20 and 21*a* in the manner described above. In the circuit section 30A, a reference oscillator 31A, which determines the scanning rate of the electrodes 20, is connected to a modulo 4 counter 32A. Outputs A0 and A1 of the modulo 4 counter 32A are connected to a voltage-control-code generating circuit 33A. The code generating circuit 33A generates voltage control codes VC00 and VC01, VC10 and VC11, VC20 and VC21, VC30 and VC31, VC40 and VC41, VC50 and 51, VC60 and VC61, and VC70 and VC71. The output terminals of the voltage code-generating circuit 33A are connected to a control voltage-generating circuit 34A.

Figure 13:
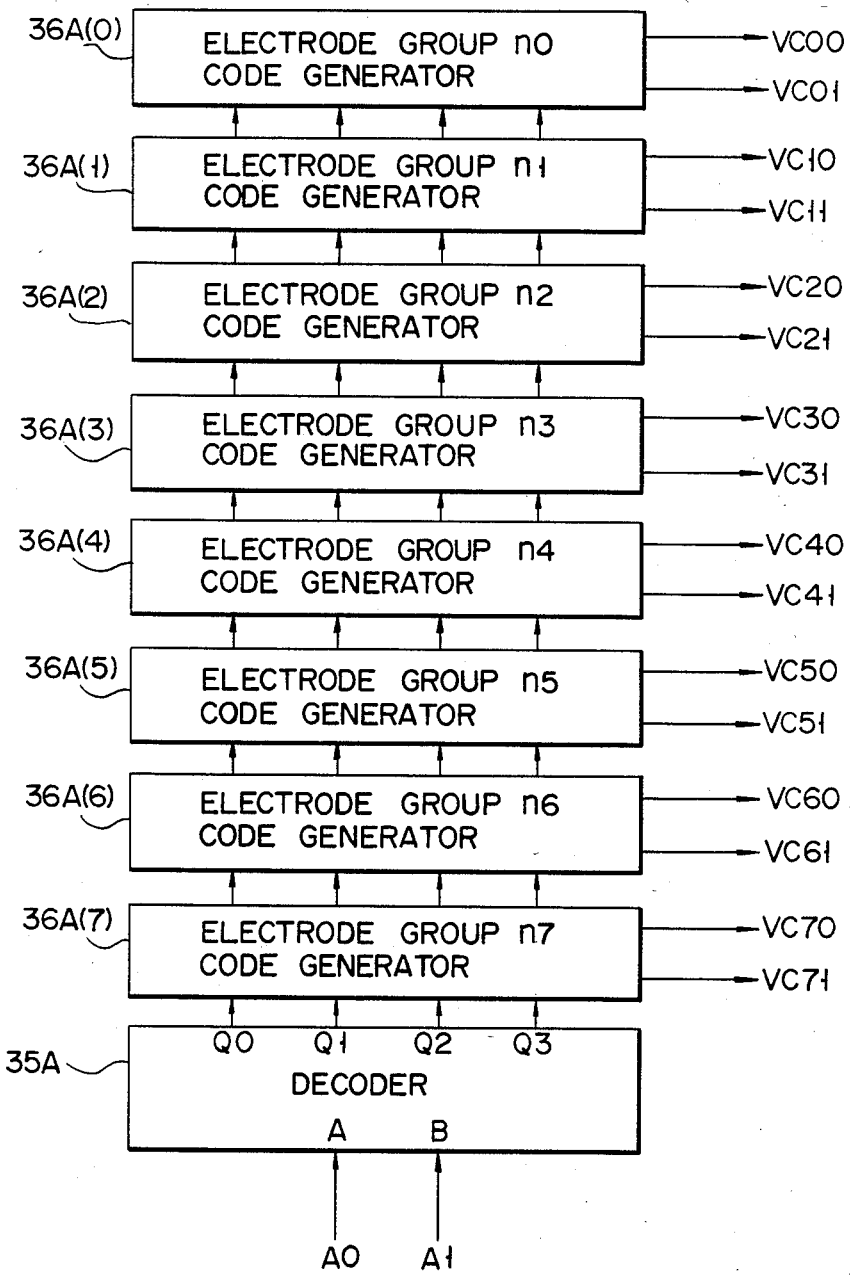
FIG. 13 is a block diagram of a voltage-control-code generating circuit in the circuit shown in FIG. 12.

The voltage-control-code generating circuit 33A is arranged in a manner shown in FIG. 13. The input terminals of a decoder 35A are connected to the modulo 4 counter 32A, and the output terminals thereof are connected to a first stage, i.e., code generator 36A(7) of code generators 36A(0) to 36A(7), which are connected with each other in series. Each of the code generators 36A(0) to 36A(7) comprises a diode matrix circuit (ROM) and stores codes corresponding to addresses. Each code generator generates voltage codes in accordance with addresses specified by the counter 32A.

Figure 14:
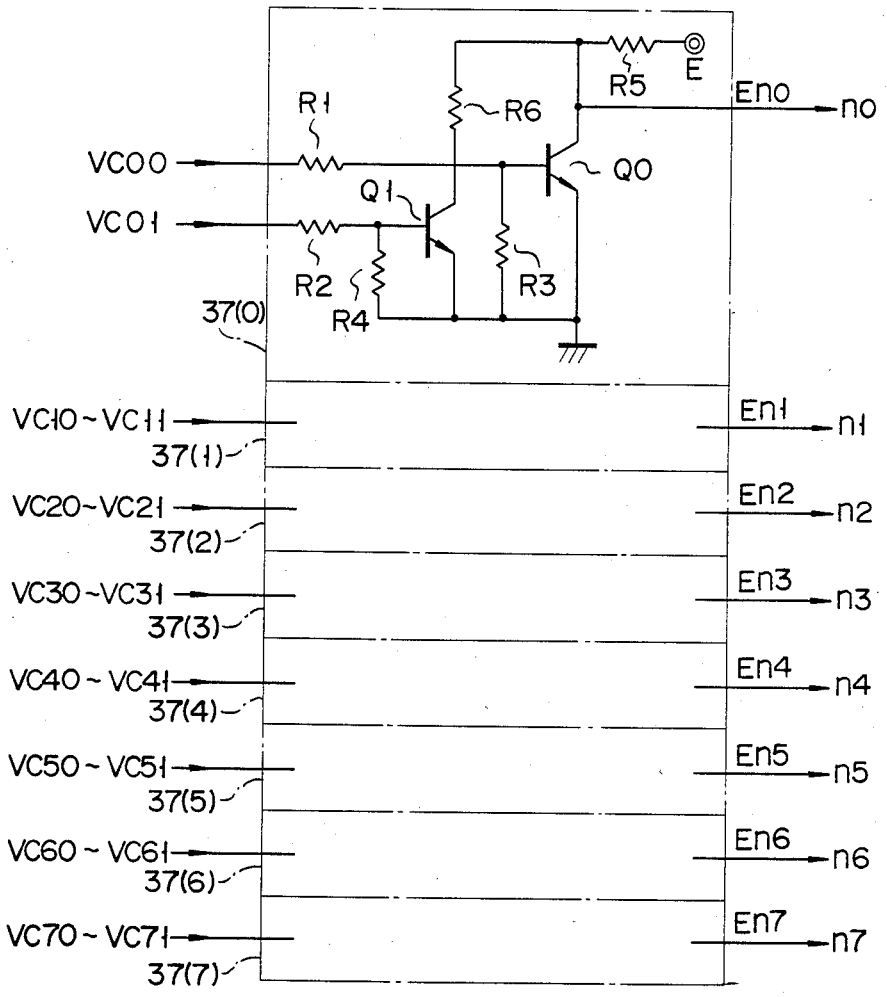
FIG. 14 is a circuit diagram of a control-voltage-generating circuit in the circuit shown in FIG. 12.

The control voltage-generating circuit 34A, as shown in FIG. 14, comprises voltage generators 37A(0) to 37A(7), which respectively generate voltages En0 to En7 corresponding to the codes generated from the voltage control code generating circuit 33A. The voltage generator 37A(0) comprises transistors Q0 and Q1 whose bases are respectively connected to bit lines of the control codes VC00 and VC01 through resistors R1 and R2 and are grounded through resistors R3 and R4 and resistors R5 and R6, respectively connected to the collectors of the transistors Q0 and Q1. The resistance of the resistor R5 is the same as that of the resistor R6. In this circuit arrangement, when the voltage control codes VC00 and VC01 are both set to be "0", the transistors Q0 and Q1 are turned off. A resultant output voltage En0 is set to be a voltage E. When the voltage code VC00 is set at logic "1" and the code VC01 is set at logic "0", the transistor Q1 is turned on and the output voltage is set at E/2. When the voltage control codes VC00 and VC01 are set at logic "1" and logic "0", respectively, the transistor Q0 is turned on and the output voltage En0 is set at the ground potential. In this manner, output voltage En0 changes among three states in accordance with the logic states of the voltage control codes VC00 and VC01. Other output voltages En1 to En7 change in the same manner as the voltage En0.

Figure 15:
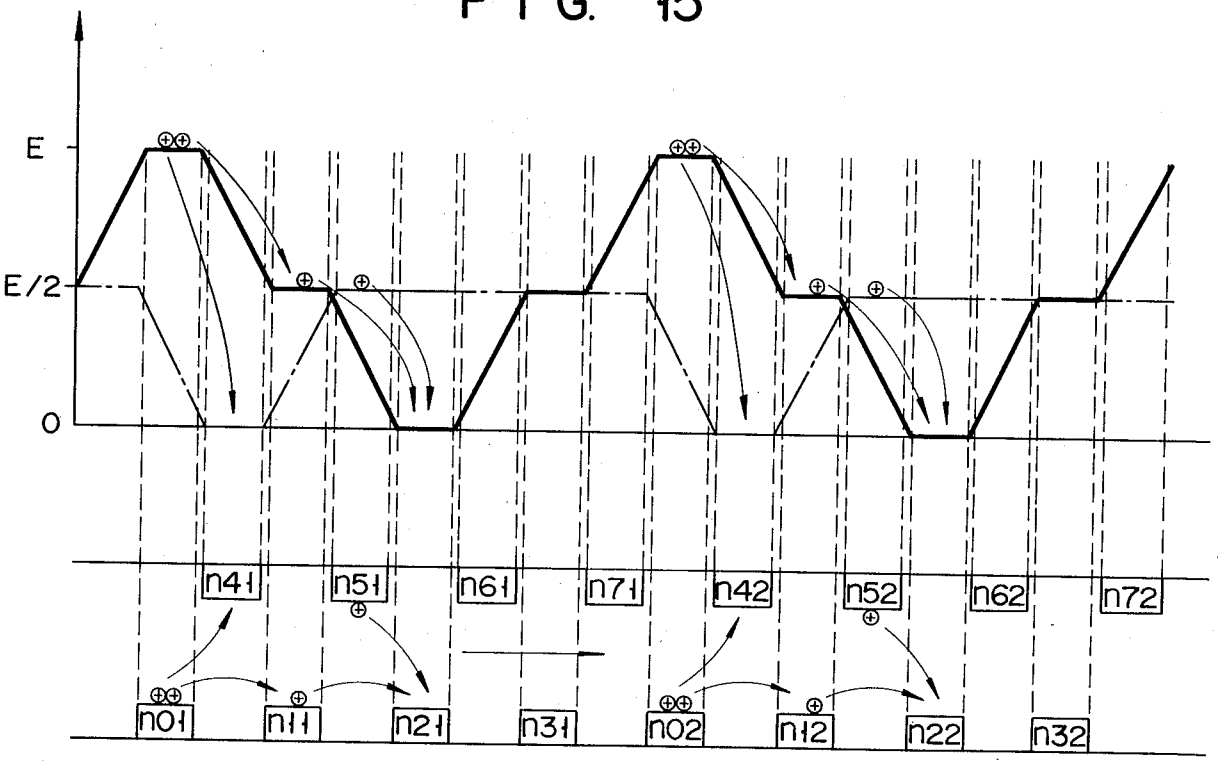
FIGS. 15 and 16 are graphs, each showing the relationship between the voltage applied to the strip electrodes and the corresponding toner carrying state thereof.
Figure 16:
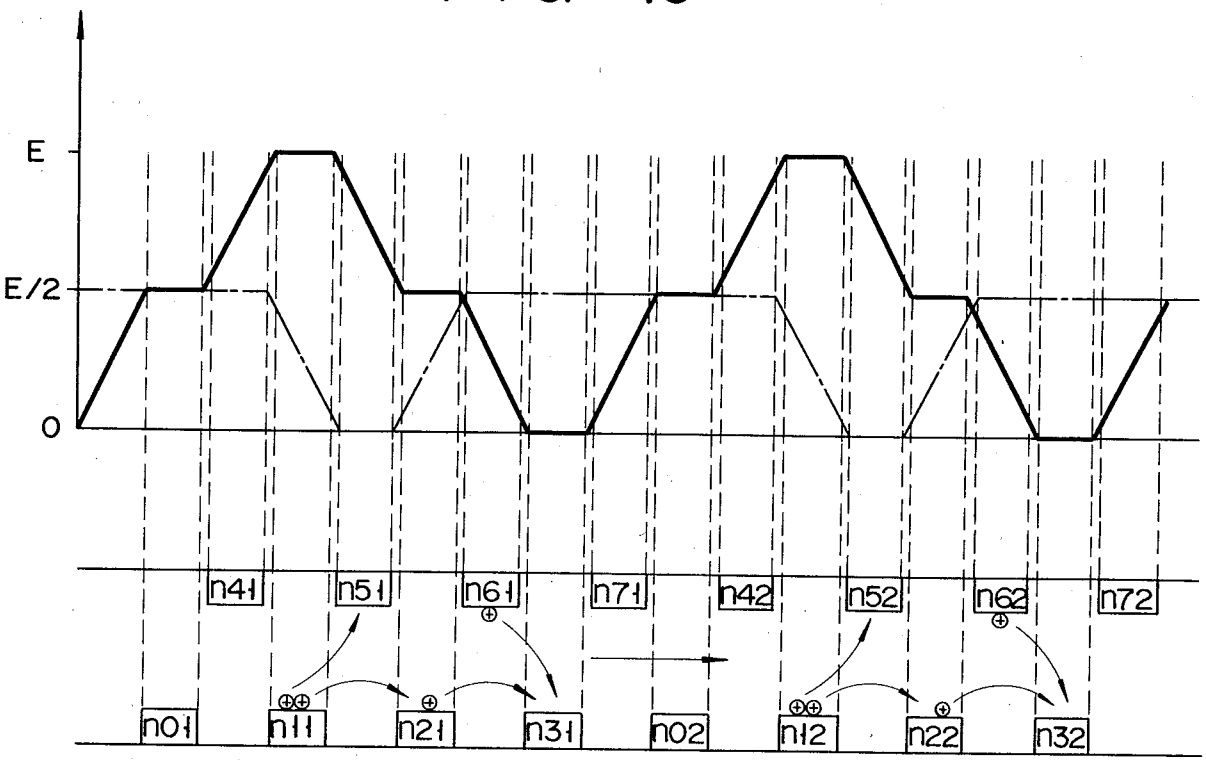

Toner, shifting in accordance with changes in the output voltages En0 to En7, will now be described with reference to FIGS. 15 and 16. At a given moment, a voltage indicated by the solid line in FIG. 15 is applied to the electrodes n01, n11, n21, n31, n02, n12, n22 and n32, and a voltage indicated by the alternate long and short dashed line is applied to the opposed electrodes n41, n51, n61, n71, n42, n52, n62 and n72. Thus, the toner particles on the electrode n01 are repelled by the electrode n01 due to the voltage applied thereon. The toner particles are then shifted from the electrode n01 to the electrode n11 or n41, which have a lower potential than that of the electrode n01. The toner particles on the electrode n11 are shifted to the electrode n21, and those on the electrode n51 are shifted to the electrode n21. Thereafter, the distribution of the voltage applied to the electrodes changes in a manner shown in FIG. 16, and the toner particles are shifted by one electrode pitch. In this manner, when the voltage distribution changes from the left to the right, the toner is shifted from the left to the right. In other words, when the distribution of the voltages applied to the electrodes 20 and 21*a* is sequentially shifted to the right, alternating electric fields, which are shifted from the left to the right, are generated, which upon application cause the toner particles to vibrate and float in a smoke-like form between the electrodes.

Figure 17:
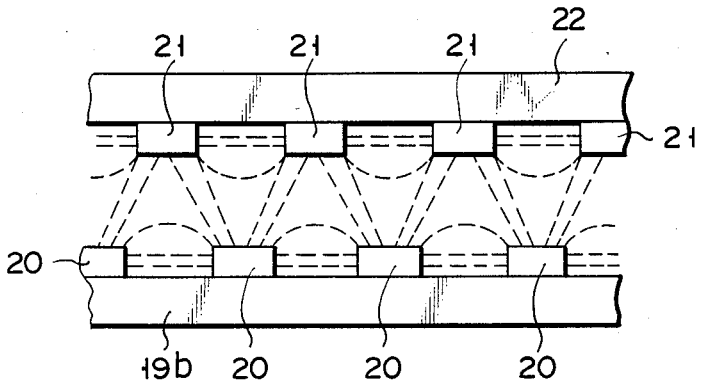
FIG. 17 is a diagram showing the distribution of lines of force in an electric field generated between the toner carrying electrodes and the opposed electrodes.

When the multi-electrode plate is disposed to oppose the toner carrier, as described above, the electric lines of force are distributed in the manner shown in FIG. 17. In other words, the electric lines of force are densified even in the central portion of each electrode, and extend above each electrode. As a result, strong electric fields are generated not only at a portion between adjacent electrodes but also at the central portion of each electrode, thereby effectively transporting the toner.

Figure 18:
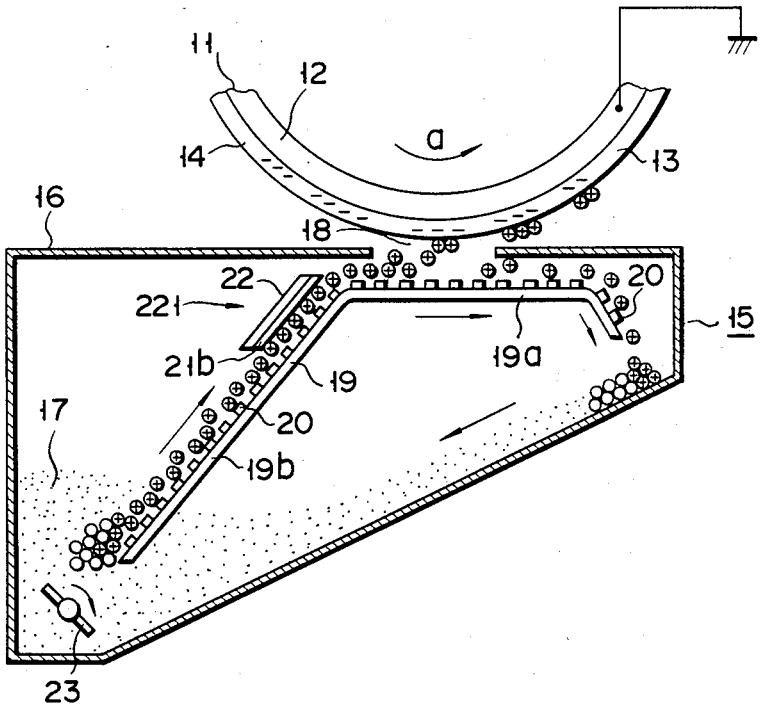
FIG. 18 schematically shows a structure of a developing apparatus, according to still another embodiment of the present invention.

Still another embodiment of the present invention will now be described with reference to FIGS. 18 and 19. According to this embodiment, an opposed electrode member 221 disposed to oppose a toner carrier 19 has electrodes 21*b* formed on an insulative plate 22 along a direction perpendicular to the longitudinal direction of electrodes 20 of the toner carrier 19. The electrodes 21*b* are of the same material and have the same width and pitch as the electrodes 20 of the toner carrier 19.

Figure 19:
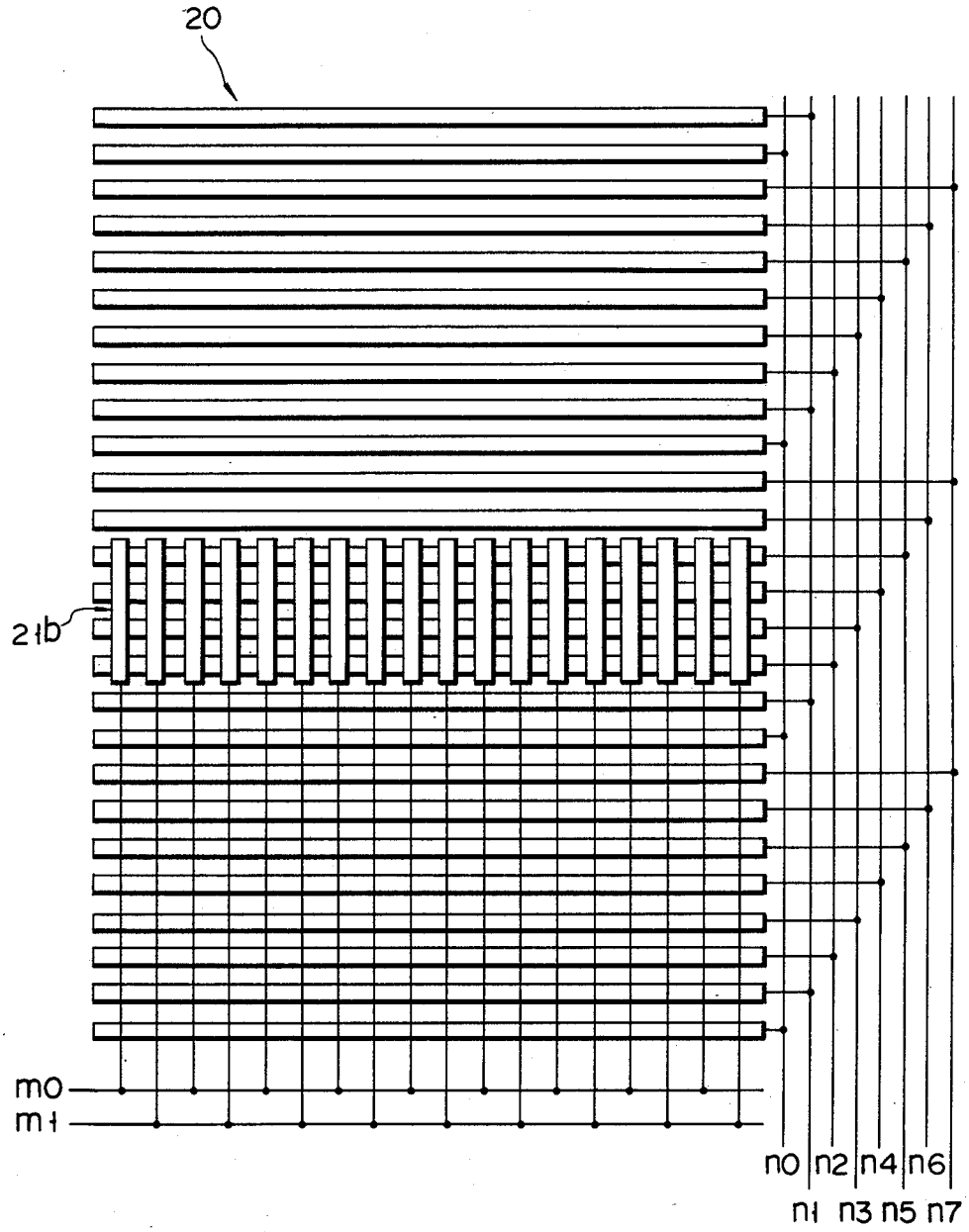
FIG. 19 is a diagram showing the arrangement of the strip electrodes of the apparatus shown in FIG. 18.
Figure 20:
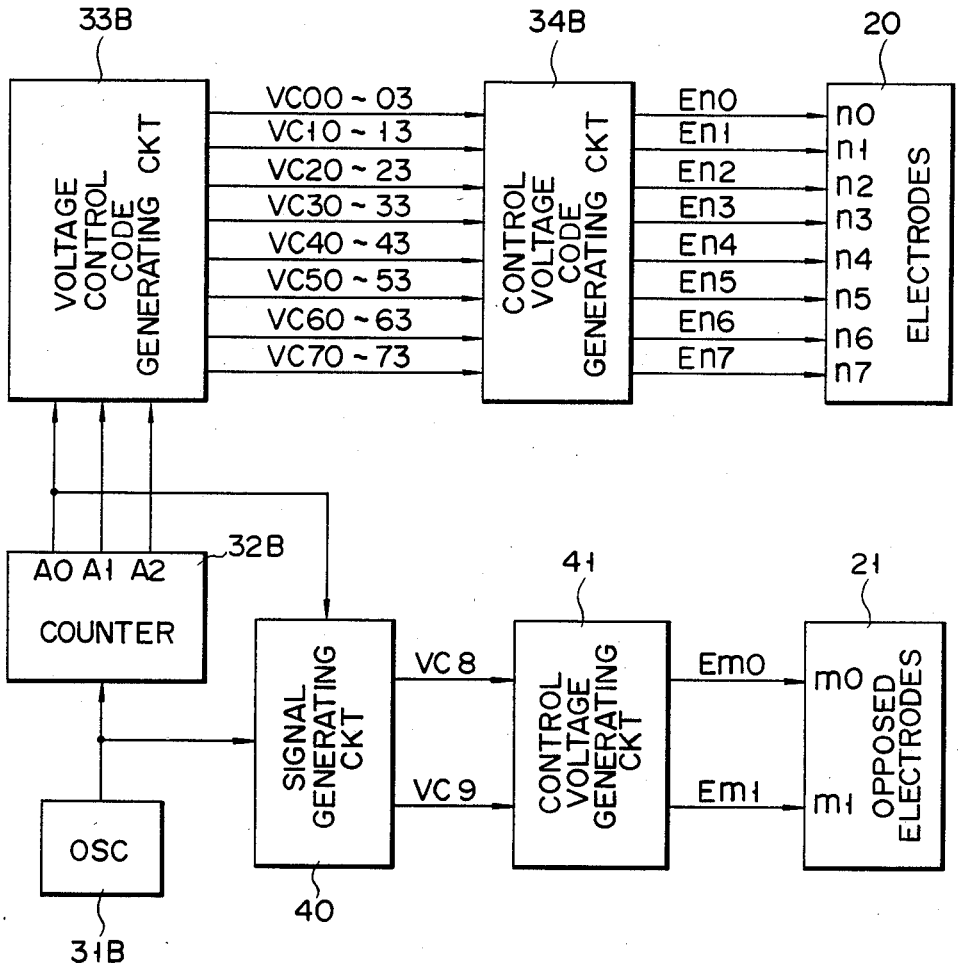
FIG. 20 is a block diagram of a circuit for applying a control voltage to the strip electrodes.

The electrodes 20 are sequentially connected to voltage lines n0 to n7 in the manner shown in FIG. 19. Every eighth electrode is commonly connected to each of the lines n0 to n7 to constitute a group, so that eight electrode groups N0 to N7 are obtained. The electrodes 21*b* are alternately connected to voltage lines m0 and m1, so that electrode groups M0 and M1, respectively corresponding to lines m0 and m1, are obtained. The electrodes 20 and 21*b* are energized by a control voltage-circuit section 30B shown in FIG. 20. In the circuit section 30B, a reference oscillator 31B, which determines the scanning rate of the electrodes 20, is connected to a modulo 8 counter 32B. Outputs A0, A1, and A2 of the modulo 8 counter 32B are connected to a voltage-control-code generator 33B. The code generator 33B generates voltage control codes VC00 to VC03, VC10 to VC13, VC20 to VC23, VC30 to VC33, VC40 to VC43, VC50 to VC53, VC60 to VC63 and VC70 to VC73 in accordance with output values of the counter 32B. The output terminals of the voltage-control-code generator 33B are connected to a control voltage generator 34B. The voltage-control-code generator 33B has the same circuit arrangement as in FIG. 4, and the control voltage generator 34B has the same circuit arrangement as in FIG. 5, thus a detailed descriptions thereof will be omitted. The output terminal of the oscillator 31B and the output terminal A0 of the counter 32B are connected to the input terminals of a signal generating circuit 40, which generates signals having opposite phases. The output terminals of the circuit 40 are connected to the input terminals of a control voltage generating circuit 41. The circuit 41 generates drive voltages Em0 and Em1 in response to signals VC8 and VC9.

Figure 21:
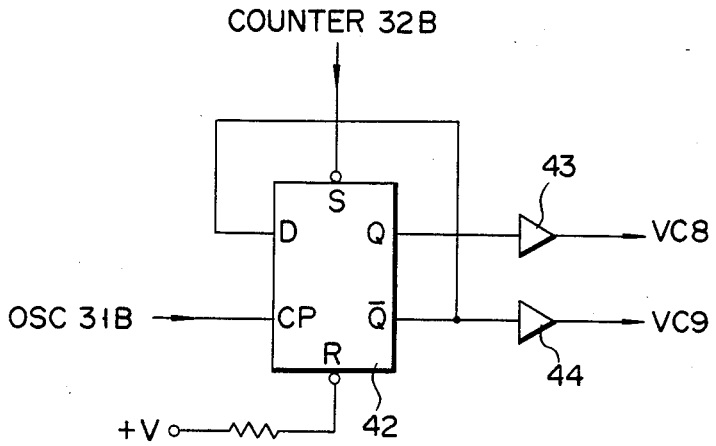
FIG. 21 is a circuit diagram of a voltage-control-code generating circuit in the circuit shown in FIG. 20.

The signal generating circuit 40 is arranged in the manner shown in FIG. 21. The output terminal of the oscillator 31B is connected to the clock input terminal (CP) of a D-type flip-flop circuit (D-FF) 42. The set input terminal (S) of the D-FF 42 is connected to the terminal A0 of the counter 32B. The data input terminal (D) of the D-FF 42 is connected to the reset output terminal ($\overline{Q}$) thereof. A set output terminal Q and the reset output terminal $\overline{Q}$ of the D-FF 42 are connected to amplifiers 43 and 44, respectively. According to this circuit arrangement, the D-FF is alternately set and reset in response to the clock signal from the oscillator 31B, so that the signals VC8 and VC9 are alternately set to be "1" level.

Figure 22:
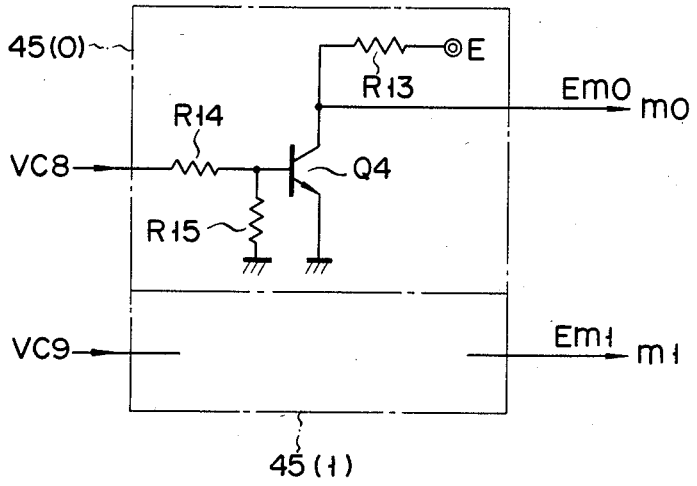
FIG. 22 is a circuit diagram of a second voltage control circuit in the circuit shown in FIG. 20.

FIG. 22 is a circuit diagram of the control voltage generating circuit 41. This circuit has voltage generators 45(0) and 45(1) which receive the signals VC8 and VC9, respectively. The voltage generator 45(0) has a transistor Q4 which is turned on in response to the "1" level signal VC8 supplied through a resistor R14. The collector of the transistor Q4 is connected to a power source E through a resistor R13, and the base thereof is grounded through a resistor R15. The voltage generator 45(1) has the same arrangement as the voltage generator 45(0).

In the above circuit, when the "1" level signal VC8 is supplied to the transistor Q4 through the resistor R14, and the transistor Q4 is turned on and the output voltage Em0 is set at the ground potential. When the signal VC8 is set at the "0" level, the transistor Q4 is turned off, and the output voltage Em0 is set at the potential E. The voltage generator 45(1) is operated in the opposite manner to that of the circuit section 45(0). Therefore, the output voltages Em0 and Em1 are alternately set at the ground potential and the potential E.

Figure 23:
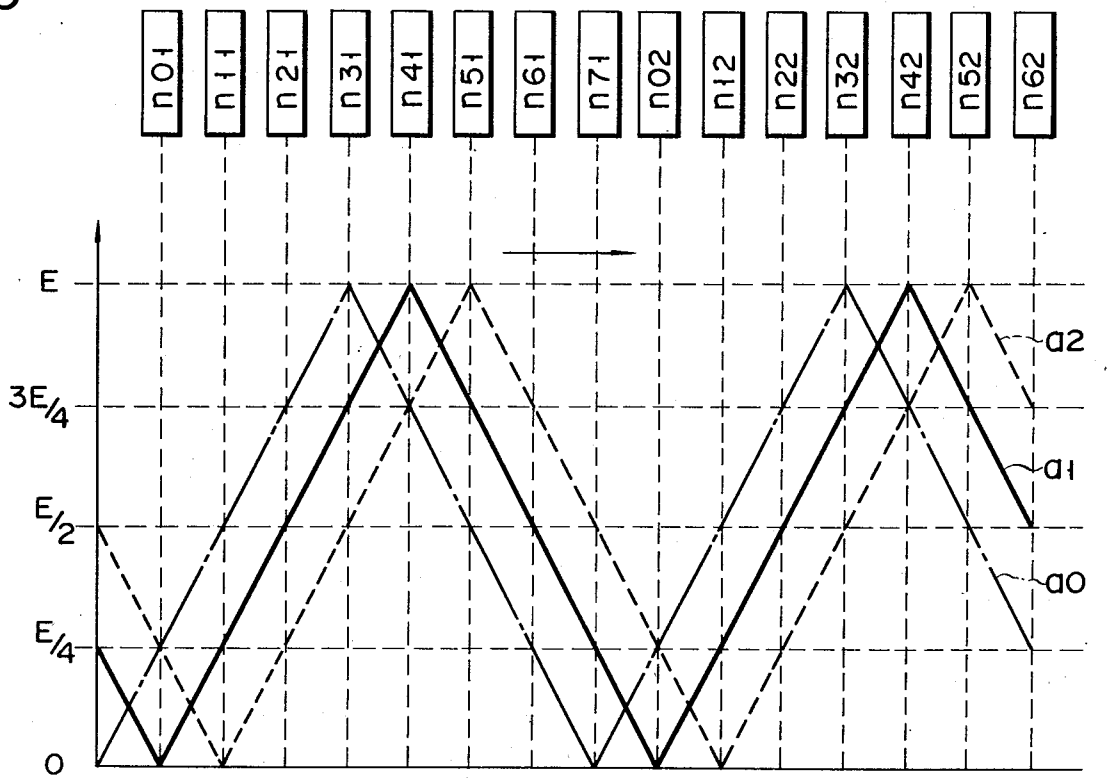
FIG. 23 is a graph showing the distribution of the voltage applied to the toner carrying electrodes.

When voltages a0, a1, and a2 are sequentially applied to electrodes n01, n11, n21, n31, . . . , in the distribution shown FIG. 23, alternating electric fields, which shift from the left to the right, are generated on the surface of the toner carrier 19, so that the toner is transported in accordance with the generated electric fields.

Figure 24:
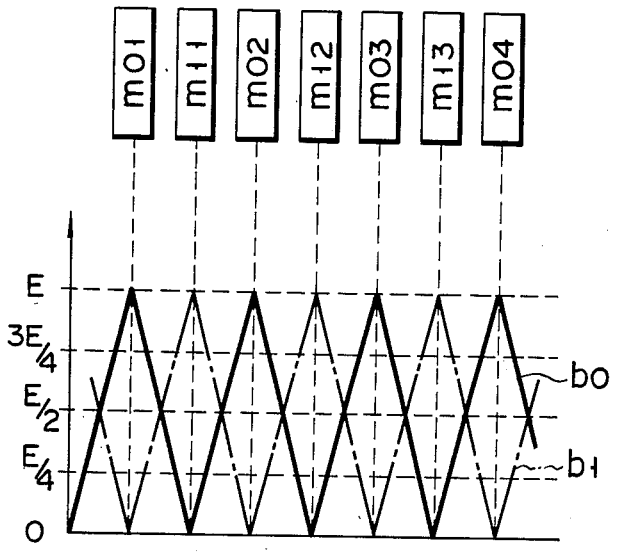
FIG. 24 is a graph showing the distribution of the voltage applied to the opposed electrodes.

Voltages are applied to the opposed electrodes in the distribution shown in FIG. 24, such that a voltage b0 is applied to electrodes m01, m02, m03, . . . of the electrode group M0 and a voltage b1 is applied to the electrodes m11, m12, m13, . . . of the electrode group M1. Electric fields are generated, which can be shifted in both the right-and-left directions with respect to the electrode plate 21. The toner transported by the toner carrier 19 is shifted in the right-and-left direction upon application of the electric fields. As a result, toner flow is uniform, and a predetermined amount of toner can be constantly supplied to the developing section.

Figure 25:
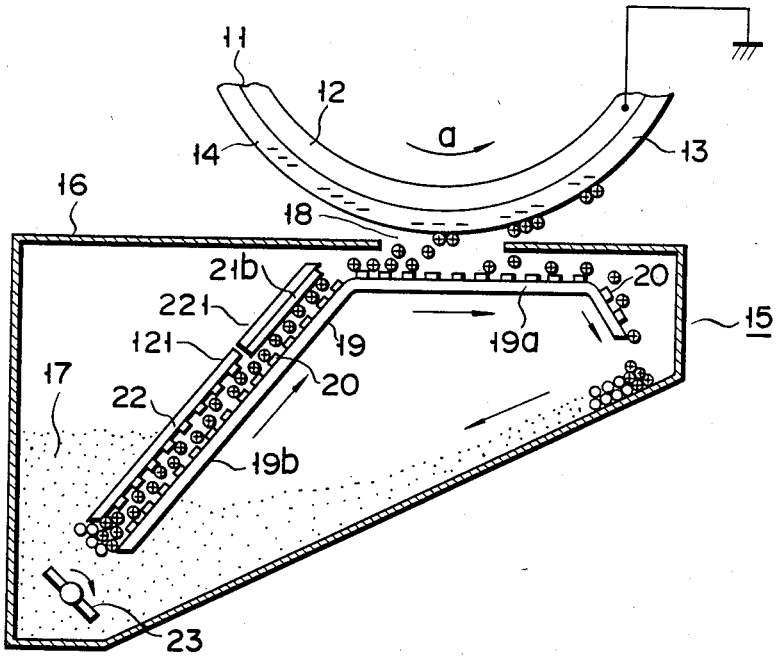
FIG. 25 schematically shows a structure of a developing apparatus, according to still another embodiment of the present invention.

In still another embodiment shown in FIG. 25, there are provided an electrode member 121 having horizontal electrodes and an opposed electrode member 221 having vertical electrodes. Toner transport efficiency can be further improved in this embodiment. The horizontal electrode member 121 and the vertical electrode member 221 may be selectively used.

In the above embodiments, the present invention is applied to developing apparatuses in electronic copying arrangements. However, the present invention may be applied to various types of image forming apparatus for developing electrostatic latent images.

What is claimed is:

1. A developing apparatus comprising:

developing medium carrying electrode means having a number of strip electrodes which are consecutively arranged at predetermined intervals and which are divided into a first section and a second section, said first section being located near a surface of a photoconductive member on which an electrostatic latent image is formed, said second section being provided with one end portion for receiving a developer medium;

first potential applying means for applying to said strip electrodes potentials which have a predetermined distribution and change as a time function, so that electric fields, shifting from said second section to said first section, are applied to said strip electrodes;

opposed electrode means disposed to oppose said second section; and second potential applying means for applying a predetermined voltage to said opposed electrode means.

2. An apparatus, according to claim 1, wherein said first potential applying means comprises means for applying to said strip electrodes different potentials, which change in a stepwise manner as a time function.

3. An apparatus, according to claim 2, wherein said first potential applying means comprises means for generating potentials E, 3E/4, E/2, E/4 and 0, where a maximum value is given to be E.

4. An apparatus, according to claim 1, wherein said opposed electrode means comprises an electrode plate disposed at a predetermined distance from said strip electrodes of said second section.

5. An apparatus according to claim 4, wherein said second potential applying means comprises means for applying to said strip electrodes a potential which falls within potentials applied to said strip electrodes of said developing-medium carrying-electrode means.

6. An apparatus, according to claim 5, wherein said second potential applying means comprises means for applying to said electrode plate a potential which is half the maximum value of the potentials generated by said first potential applying means.

7. An apparatus, according to claim 4, wherein said strip electrodes of said second section are spaced by 0.2 to 1.0 mm apart from said electrode plate so as to oppose said electrode plate.

8. An apparatus, according to claim 1, wherein said opposed electrode means comprises a number of strip electrodes which are aligned parallel to said strip electrodes of said developing medium carrying means, which are applied with the potentials from said first potential applying means and connected to said second potential applying means.

9. An apparatus, according to claim 8, wherein said strip electrodes of said developing medium carrying means respectively have a width of 0.1 to 0.5 mm and a pitch of 0.1 to 0.5 mm, said strip electrodes of said opposed electrode means respectively have a width of 0.1 to 0.5 mm and a pitch of 0.1 to 0.5 mm, said opposed electrode means being arranged with respect to said carrying means such that said strip electrodes of said developing medium carrying means are offset from said strip electrodes of said opposed electrode means.

10. An apparatus, according to claim 8, wherein said second potential applying means comprises means for applying to said strip electrodes of said opposed electrode means potentials, changing in response to changes in potentials applied from said first potential applying means, so as to generate electric fields shifting in response to the electric fields generated on said strip electrodes of said developing medium carrying electrode means.

11. An apparatus, according to claim 1, wherein said opposed electrode means comprises strip electrodes which are aligned at equal intervals along a direction perpendicular to a longitudinal direction of said strip electrodes of said carrying electrode means, and which are connected to said second potential applying means.

12. An apparatus, according to claim 11, wherein said second potential applying means comprises means for intermitently applying a predetermined potential to said strip electrodes of said opposed electrode means, which are separated by at least one electrode thereof to form electric fields which shift along a direction perpendicular to a longitudinal direction of said strip electrodes of said carrying electrode means.

13. An apparatus, according to claim 11, wherein said strip electrodes of said developing-medium carrying means have a width of 0.1 to 0.5 mm and a pitch of 0.1 to 0.5 mm, and said strip electrodes of said opposed electrode means have a width of 0.1 to 0.5 mm and a pitch of 0.1 to 0.5 mm.

14. An apparatus, according to claim 1, wherein said developing medium carrying means and said opposed electrode means are disposed in a toner container.

15. An apparatus, according to claim 14, wherein said toner container has means for stirring said toner.

16. An apparatus, according to claim 1, wherein said carrying electrode means comprises a horizontal electrode portion corresponding to said first section, and an inclined portion which descends beyond one end of said horizontal electrode portion.

* * * * *